US009139967B2

(12) United States Patent
Sharipov

(10) Patent No.: US 9,139,967 B2
(45) Date of Patent: Sep. 22, 2015

(54) PARKING POST

(71) Applicant: Irek Sharipov, Holon (IL)

(72) Inventor: Irek Sharipov, Holon (IL)

( * ) Notice: Subject to any disclaimer, the term of this patent is extended or adjusted under 35 U.S.C. 154(b) by 26 days.

(21) Appl. No.: 14/191,294

(22) Filed: Feb. 26, 2014

(65) Prior Publication Data

US 2014/0241798 A1 Aug. 28, 2014

(30) Foreign Application Priority Data

Feb. 27, 2013 (GB) ..... 1303458.2

(51) Int. Cl.
*E01F 13/00* (2006.01)
*E01F 13/04* (2006.01)

(52) U.S. Cl.
CPC ..... *E01F 13/046* (2013.01)

(58) Field of Classification Search
CPC ..... E01F 13/046
USPC ..... 404/10, 11
See application file for complete search history.

(56) References Cited

U.S. PATENT DOCUMENTS 8,226,322 B2 * 7/2012 Blair ..... 404/11
8,579,540 B2 * 11/2013 Lafont ..... 404/11

* cited by examiner

*Primary Examiner* — Raymond W Addie
(74) *Attorney, Agent, or Firm* — Mark David Torche; Patwrite LLC

(57) ABSTRACT

A parking post capable of assuming retracted and protracted conformations includes a post moiety including an essentially elongated hollow body and a locking mechanism, adapted to secure the post in the protracted conformation. The parking post includes a pedestal moiety, including top and bottom frames, a housing connected to the top frame, at least two pulleys adapted to receive a string, at least two plummets vertically translatable within the pedestal moiety, the collective weight of which somewhat exceeds the weight of the post moiety. Strings are threaded onto the pulleys and interconnect the plummets with the jogs on the post moiety. An actuation mechanism is used to secure the parking post in the retracted and protracted conformations.

16 Claims, 4 Drawing Sheets

10B
12
16
18
20
25
27
28
30
32
34
36
38
40A
40B
42A
44A
46A
48A
48B
50
52
54
56
58
59
61
62
C
D

PARKING POST

TECHNICAL FIELD

The present invention generally relates to parking post. In particular, the invention relates to parking post capable of assuming retracted and protracted conformations and a mechanism therefor.

BACKGROUND OF THE INVENTION

It is disclosed that the pertinent state-of-the-art is represented by U.S. Pat. Nos. 3,451,164, 3,698,135 5,961,249; GB patent applications GB2305199A, GB2346642A and GB2435669A as well as by international patent application having publication number WO1998/024979.

BRIEF DESCRIPTION OF THE DRAWINGS

The present invention will be understood and appreciated more comprehensively from the following detailed description taken in conjunction with the appended drawings in which:

While the invention is susceptible to various modifications and alternative forms, specific embodiments thereof have been shown by way of example in the drawings. The components in the drawings are not necessarily to scale, emphasis instead being placed upon clearly illustrating the principles of the present invention. FIG. 5

DETAILED DESCRIPTION OF THE INVENTION

Figure 1B:
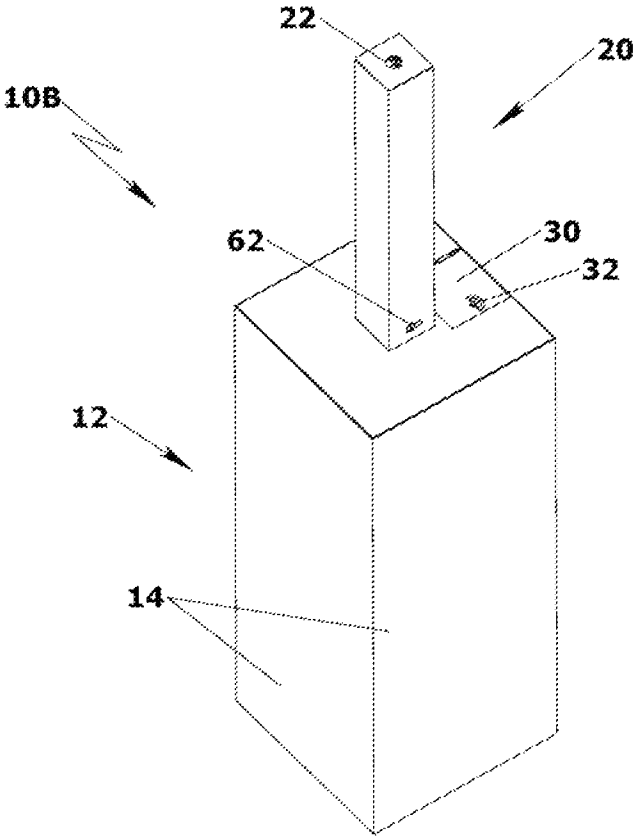
FIG. 1B is an isometric view of the parking post of the invention in a protracted conformation.
Figure 1A:
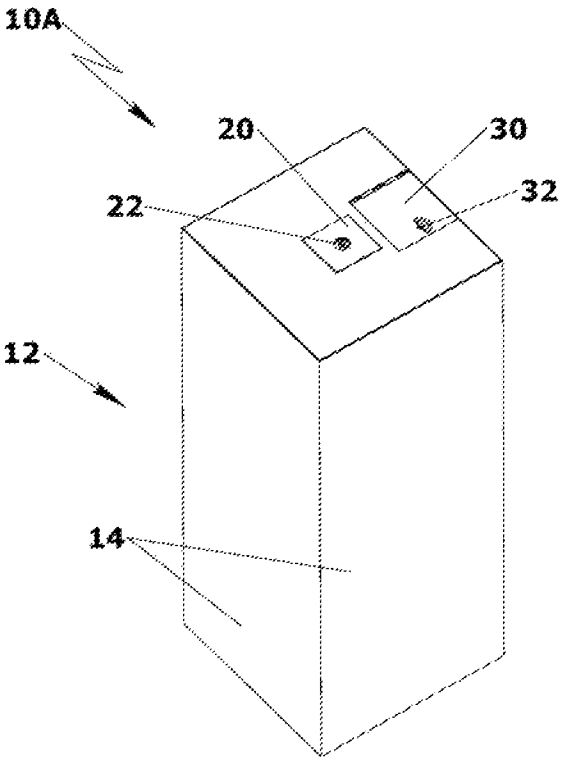
FIG. 1A is an isometric view of the parking post of the invention in a retracted conformation.

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another.

Moreover, it will be appreciated that the effort of such a development might be complex and time-consuming, but would nevertheless be a routine undertaking for those of ordinary skill in the art having the benefit of this disclosure.

In accordance with some embodiments of the parking post of present invention reference is now made to FIGS. 1A to 4D. The parking post of the present invention assumes retracted and protracted conformations 10A and 10B, respectively. The parking post comprises pedestal moiety 12 and post moiety 20. The top of post moiety 20 is furnished a pulling ring 22. Pulling ring 22 is used to apply a forceful pulling to post moiety 20, thereby recovering post 20 whenever it is stuck.

Pedestal moiety 12 is covered by an enclosure of plates 14. Pedestal moiety 12 is formed by top and bottom frames 18 and 16, respectively. Top frame 18 is connected housing 27. Ribs 25 extend from housing 27. Ribs 25 interconnect between housing 27 and enclosure plates 14. Enclosure plates 14 are typically welded to each other at about 90 degrees angle as well as to ribs 25 at about 45 degrees angle. Housing 27 is used as the guiding rail for post moiety 20; conferring the latter a translation an essentially paralleling to the former.

A plurality of rollers 28 are disposed in-between housing 27 and post 20; preferably four rollers 28 are disposed on each interior face housing 27 facing vis-à-vis post 20. Rollers 28 are preferably affixed to the interior faces housing 27 facing vis-à-vis post 20. Rollers 28 are implemented to facilitate a smooth continuous translation of post 20 relatively to housing 27.

Figures 3A, 3B, 3C, 3D:
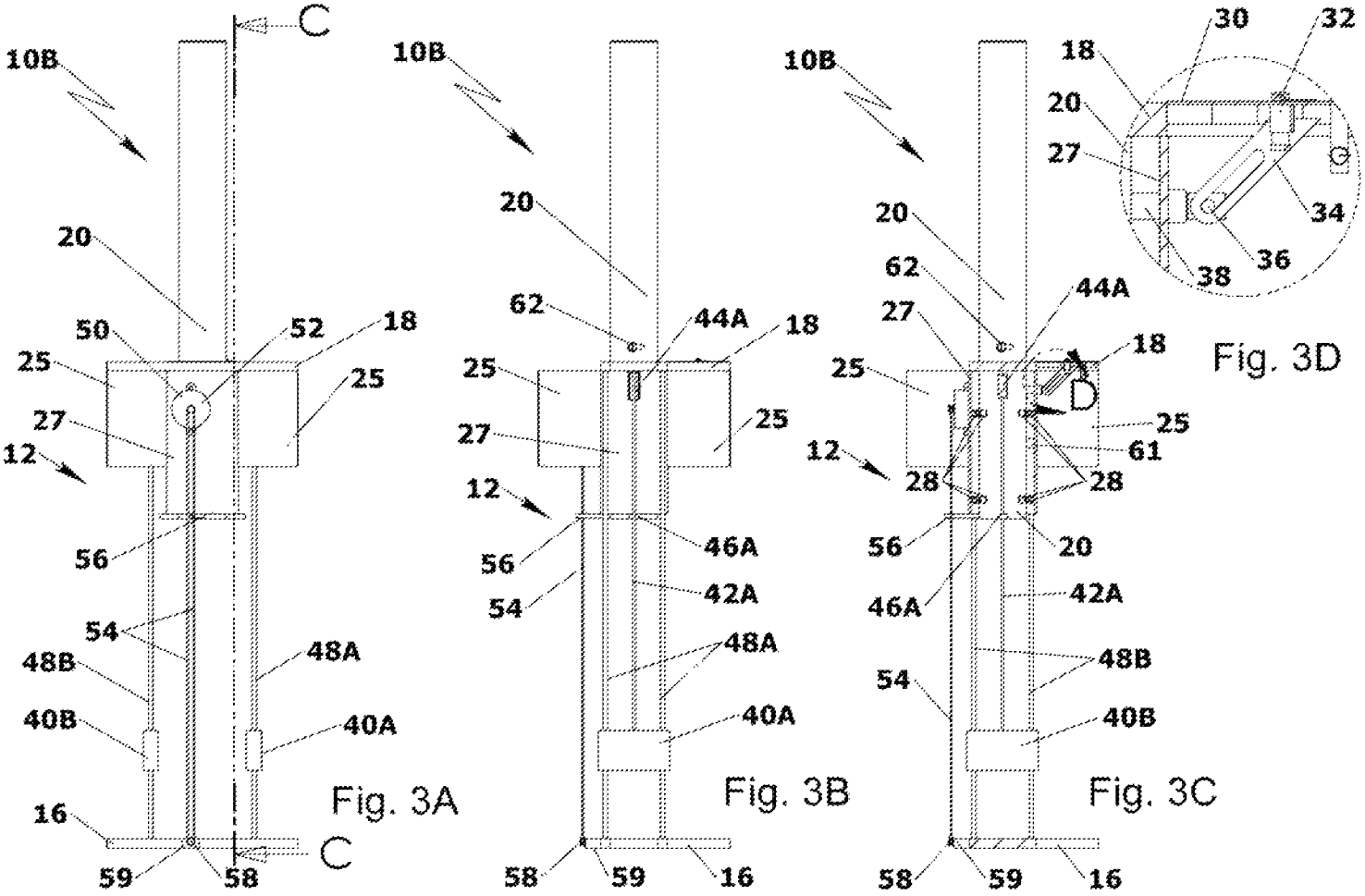
FIG. 3A is a side view of the mechanism of the parking post of the invention in a protracted conformation.
FIG. 3B is a front view of the mechanism of the parking post of the invention in a protracted conformation.
FIG. 3C is a cross-sectional front view of the mechanism of the parking post of the invention shown in FIG. 3B, wherein the cross-section is performed in accordance with the cross-section line C, apparent in FIG. 3A.
FIG. 3D is an enlarged view of the mechanism of the parking post of the invention shown in FIG. 3C.
Figures 4A, 4B, 4C, 4D:
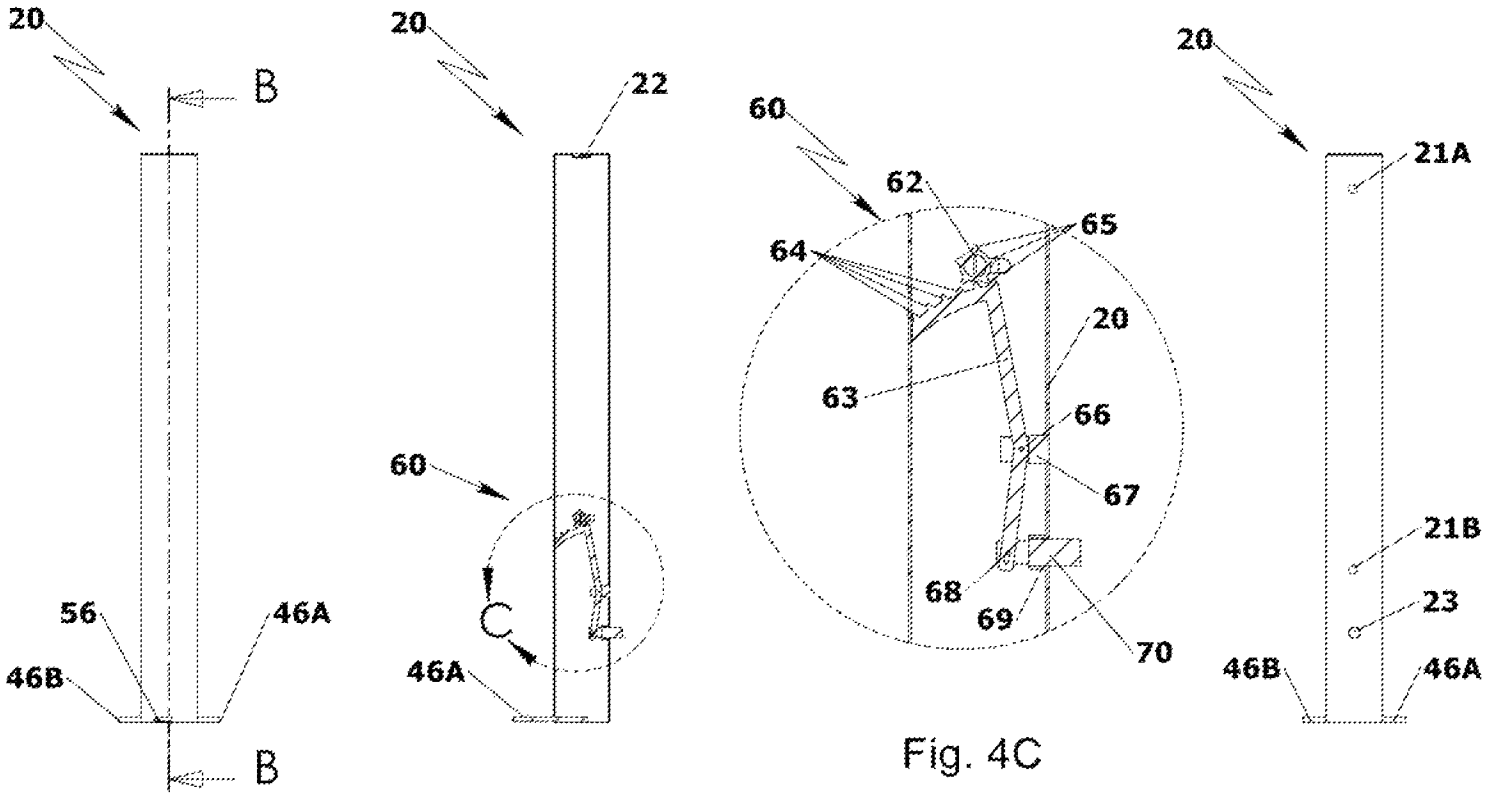
FIG. 4A is a side view of the post moiety of the mechanism of the invention.
FIG. 4B is a cross-sectional view of the post moiety shown in FIG. 4A.
FIG. 4C is an enlarged view of the locking mechanism of the post moiety, the cross-sectional view of which is shown in FIG. 4B.
FIG. 4D is a side view of the post moiety of the mechanism of the invention.

The mechanism of the parking post comprises plummets 40A and 40B. Plummet 40A is connected to string 42A, whereas plummet 40B is connected to a respective string (not shown), from the opposite (back) side of housing 27. String 42A is threaded onto pulley 41A, whereas string the aforesaid respective string (not shown), is threaded onto another pulley (not shown), from the opposite (back) side of housing 27. In FIGS. 3A to 3C, the aforesaid respective string (not shown) and aforesaid another pulley (not shown), which are found on the back side of housing 27 are hidden by housing 27 and post 20; therefore in lieu of numerals these string and pulley are denoted herein as the counterpart string and counterpart pulley.

String 42A and the counterpart string are then drawn form said pulley 41A and counterpart pulley, respectively, downwards to jogs 46A and 46B of post 20; thereby essentially counterbalancing the weight of post 20 by the weight of plummets 40A and 40B, from both sides of post 20. Guiding strings 48A and 48B are threaded into apertures in or arcuate/annular on the surface of plummets 40A and 40B; thereby facilitating a continuous alignment during the vertical translation thereof, essentially paralleling post 20.

Figure 2B:
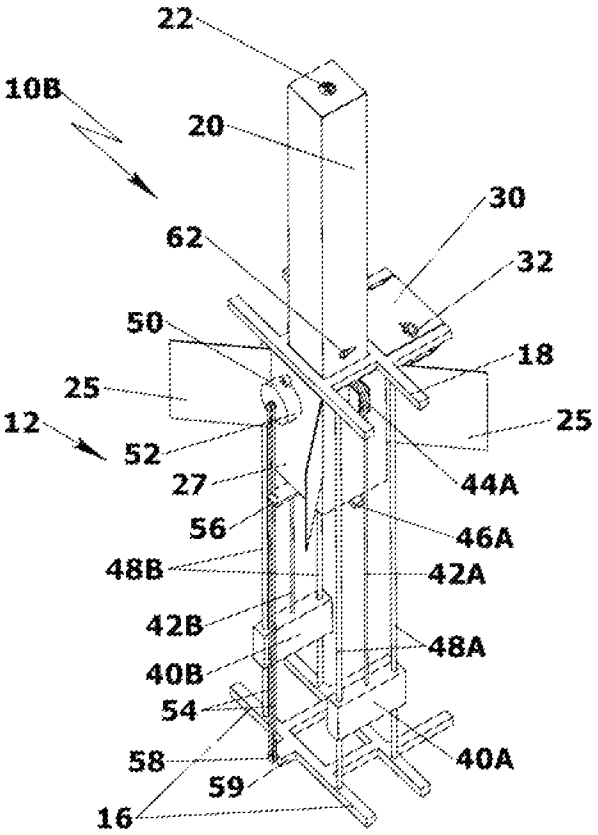
FIG. 2B is an isometric view of the mechanism of the parking post of the invention in a protracted conformation.
Figure 2A:
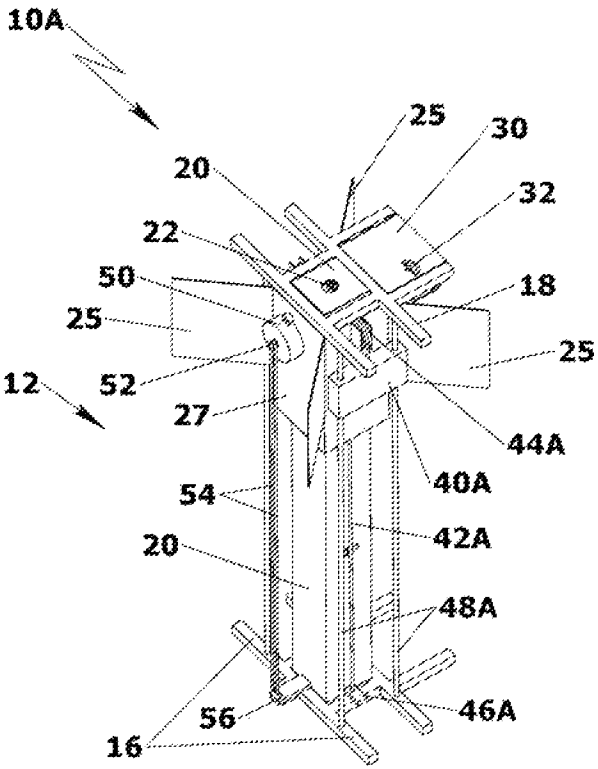
FIG. 2A is an isometric view of the mechanism of the parking post of the invention in a retracted conformation.

The collective weight of plummets 40A and 40B is typically predefined to somewhat exceed the weight of post 20; whereby the mechanism of the parking post spontaneously assumes protracted conformation 10B, wherein plummets 40A and 40B assume a lower position, shown in FIG. 2B; whereas upon purposeful application of manual force to post 20 in the direction towards pedestal moiety 12, the mechanism of the parking post is driven into retracted conformation 10A, wherein plummets 40A and 40B assume an upper position, shown in FIG. 2A.

Actuation pedal 30, which is used to secure the mechanism of the parking post in retracted and protracted conformations 10A and 10B, is pivotally connected to top frame 18. Pedal 30 is furnished with safety-catch 32, preventing unintentional actuation pedal 30. Slanted element 34, having an elongated oval aperture therein, is affixed to the bottom face of pedal 30.

Pin 36 is threaded into the elongated oval aperture of slanted element 34. Pin 36 is connected to striker 38, which is inserted through a respective aperture in housing 27 into apertures 21A and 21B in post 20, respectively, in retracted and protracted conformations 10A and 10B. Upon application of force to pedal 30 in the direction towards the bottom, slanted element 34 is translated somewhat top towards bottom frame 16 thereby the oval aperture therein retracts striker 38 from pin 36 away from post 20, driving striker 38 out of apertures 21A and 21B in post 20, respectively, in retracted and protracted conformations 10A and 10B.

The mechanism of the parking post further comprises electrical motor 50. Electrical motor 50 is rotationally coupled to a gear, preferably of a planetary type. The rotor of the gear terminates with reel/sprocket 52. Belt/chain 54 is wound onto reel/sprocket 52 and reel/sprocket 58, mounted onto jog 59 of bottom frame 16. Jog 56 of post 20 is operationally connected belt/chain 54; thereby upon rotation reels/sprockets 52 and 58, belt/chain 54 is translated together with jog 56 thus retracting and protracting post 20. Motor 50 is coupled to an electric circuitry, including an energy source, preferably of a portable type, e.g. electrical battery, and a control module. The control module is connected to two microswitches disposed on jog 59 of bottom frame 16 and housing 27. Upon a contact with jog 56 of post 20 with the microswitches the operation of motor 50 is terminated. The control module comprises a remote control sub-module, which can be operated by a respective remote; thereby the parking post of the invention can be in retracted/protracted without any application of manual force, namely without leaving the vehicle.

The mechanism of the parking post further comprises locking mechanism 60, adapted to secure post 20 in protracted conformation 10B. Locking mechanism 60 comprises cylinder 62, wherein the driving element is a sprocket furnished with cogs 65. Cylinder 62 is a standard door-lock key-cylinder known in the art, such as the Euro Profile Cylinder available from Mul-T-Lock Technologies Ltd., Yavne 81104, Israel. Yoke 63 comprises an arcuate portion furnished with respective cogs 64; whereby upon rotation of cylinder 62 arcuate portion furnished with respective cogs 64 is translated along the sprocket furnished of the former. Yoke 63 is pivotally mounted on pivot 66 that is affixed in protrusion 67. The terminal portion of yoke 63, distant from cylinder 62, is pivotally connected to pivot 68 that affixed to striker 70. Striker 70 is inserted into aperture 23 in post 20. Circumferential ridge 69 is used to position striker 70 substantially perpendicularly to the face of post 20 with aperture 23 therein.

Upon a counterclockwise rotation of cylinder 62, striker 70 is retracted towards the interior of post 20; whereas upon a clockwise rotation of cylinder 62, striker 70 is protracted away from post 20 and can be inserted into aperture 61 within housing 27 in protracted conformation 10B; thereby locking post 20 in protracted conformation 10B.

It will be appreciated by persons skilled in the art that the present invention is not limited by what has been particularly shown and described herein above. Rather the scope of the invention is defined by the claims which follow:

What is claimed is:

1. A parking post mechanism capable of assuming retracted and protracted conformations, comprising:

(a) a post moiety, comprising:
  (I) an essentially elongated hollow body;
  (II) a locking mechanism, disposed within said body, said locking mechanism is adapted to secure said post in said protracted conformation; wherein said locking mechanism comprises:
    (i) a cylinder, wherein said cylinder comprises a sprocket furnished with cogs;
    (ii) a yoke pivotally mounted inside said body, and
    (III) a striker operationally connected to said yoke;
  (III) at least two jogs extending from the bottom of said body;
  (IV) at least two apertures in said body;

(b) a pedestal moiety, comprising:
  (I) top and bottom frames;
  (II) a housing connected to said top frame, used as a guiding means for conferring a translation said post moiety essentially paralleling thereto;
  (III) enclosure plates interconnected by ribs to said housing;
  (IV) a plurality of rollers, disposed in-between said housing and said post moiety; facilitate a smooth translation of said post moiety relatively to said housing;

(c) at least two pulleys disposed on said housing, wherein each of said pulleys is adapted to receive a string;

(d) at least two plummets, vertically translatable within said pedestal moiety; wherein the collective weight of said plummets is predefined to somewhat exceed the weight of said post moiety;

(e) at least two strings, threaded onto said at least two pulleys and respectively interconnecting said plummets with said jogs of said post moiety;

(f) an actuation mechanism, used to secure the mechanism of the parking post in said retracted and protracted conformations, comprising:
  (I) a pedal pivotally connected to said top frame;
  (II) a slanted element having an elongated oval aperture therein affixed to the bottom face of said pedal;
  (III) a striker operationally connected to said slanted element, said striker is inserted through a respective aperture in said housing into said at least two apertures in said body.

2. The parking post mechanism as set forth in claim 1, wherein said post moiety further comprising a pulling ring, used to apply a forceful pulling to said post moiety, thereby recovering post whenever said post moiety is stuck.

3. The parking post mechanism as set forth in claim 1, further comprising at least two guiding strings, threaded into apertures in or arcuate/annular on the surface of said plummets; thereby facilitating a continuous alignment during the vertical translation thereof, essentially paralleling to post.

4. The parking post mechanism as set forth in claim 1, further comprising a safety-catch, preventing an unintentional actuation of said pedal.

5. The parking post mechanism as set forth in claim 1, further comprising:

(a) an electrical motor, rotationally coupled to a gear, wherein the rotor of said gear terminates with a reel/sprocket;

(b) a reel/sprocket, mounted onto a jog of said bottom frame;

(c) a belt/chain, wound onto said reel/sprocket;

(d) a jog on said post, operationally connected to said belt/chain;

thereby upon rotation said reels/sprockets, said belt/chain is translating said jog on said post thus retracting/protracting said post.

6. The parking post mechanism as set forth in claim 5, wherein said electrical motor further comprising an electric circuitry, an energy source, a control module and at least two microswitches disposed on a jog of said bottom frame and on said hosing; whereby upon a contact with a jog on said post the operation of said motor is terminated.

7. The parking post mechanism as set forth in claim 6, wherein said control module further comprising a remote control sub-module, which can be operated by a respective remote; thereby said parking post can be in retracted/protracted without an application of manual force thereto.

8. The parking post mechanism as set forth in claim 6, wherein said energy source is of a portable type.

9. A parking post mechanism capable of assuming retracted and protracted conformations, comprising:

(a) a post moiety, comprising:

(I) an essentially elongated hollow body;

(II) at least two jogs extending from the bottom of said body;

(III) at least two apertures in said body;

(b) a pedestal moiety, comprising:

(I) top and bottom frames;

(II) a housing connected to said top frame, used as a guiding means for conferring a translation said post moiety essentially paralleling thereto;

(III) a plurality of rollers, disposed in-between said housing and said post moiety; facilitate a smooth translation of said post moiety relatively to said housing;

(c) at least two pulleys disposed on said housing, wherein each of said pulleys is adapted to receive a string;

(d) at least two plummets, vertically translatable within said pedestal moiety; wherein the collective weight of said plummets is predefined to somewhat exceed the weight of said post moiety;

(e) at least two strings, threaded onto said at least two pulleys and respectively interconnecting said plummets with said jogs of said post moiety;

(f) an actuation mechanism, used to secure the mechanism of the parking post in said retracted and protracted conformations, comprising:

(I) a pedal pivotally connected to said top frame;

(II) a slanted element having an elongated oval aperture therein affixed to the bottom face of said pedal;

(III) a striker operationally connected to said slanted element, said striker is inserted through a respective aperture in said housing into said at least two apertures in said body.

10. The parking post mechanism as set forth in claim 9, wherein said post moiety further comprising a pulling ring, used to apply a forceful pulling to said post moiety, thereby recovering post whenever said post moiety is stuck.

11. The parking post mechanism as set forth in claim 9, further comprising at least two guiding strings, threaded into apertures in or arcuate/annular on the surface of said plummets; thereby facilitating a continuous alignment during the vertical translation thereof, essentially paralleling to post.

12. The parking post mechanism as set forth in claim 9, further comprising a safety-catch, preventing an unintentional actuation of said pedal.

13. The parking post mechanism as set forth in claim 9, further comprising:

(a) an electrical motor, rotationally coupled to a gear, wherein the rotor of said gear terminates with a reel/sprocket;

(b) a reel/sprocket, mounted onto a jog of said bottom frame (c) a belt/chain, wound onto said reel/sprocket (d) a jog on said post, operationally connected to said belt/chain; thereby upon rotation said reels/sprockets, said belt/chain is translating said jog on said post thus retracting/protracting said post.

14. The parking post mechanism as set forth in claim 13, wherein said electrical motor further comprising an electric circuitry, an energy source, a control module and at least two microswitches disposed on a jog of said bottom frame and on said hosing; whereby upon a contact with a jog on said post the operation of said motor is terminated.

15. The parking post mechanism as set forth in claim 14, wherein said control module further comprising a remote control sub-module, which can be operated by a respective remote; thereby said parking post can be in retracted/protracted without an application of manual force thereto.

16. The parking post mechanism as set forth in claim 14, wherein said energy source is of a portable type.

* * * * *